United States Patent [19]

Sung

[11] 4,348,210

[45] Sep. 7, 1982

[54] NOVEL PROCESS AND PRODUCT

[75] Inventor: Rodney L. Sung, Fishkill, N.Y.

[73] Assignee: Texaco Inc., White Plains, N.Y.

[21] Appl. No.: 206,814

[22] Filed: Nov. 14, 1980

[51] Int. Cl.[3] ..... C10L 1/02

[52] U.S. Cl. ..... 44/56; 44/53; 252/77; 252/392

[58] Field of Search ..... 44/56, 53, 71; 252/392, 252/77, 51.5 A

[56] References Cited

U.S. PATENT DOCUMENTS

| | | | |
|---|---|---|---|
| 3,773,479 | 11/1973 | Dorn et al. | 44/71 |
| 3,980,448 | 9/1976 | Haemmerle et al. | 252/394 |
| 4,018,702 | 4/1977 | Boffardi et al. | 252/392 |
| 4,047,900 | 9/1977 | Dorn et al. | 44/71 |
| 4,144,036 | 3/1979 | Cummings | 44/71 |

*Primary Examiner*—Winston A. Douglas
*Assistant Examiner*—Y. Harris-Smith
*Attorney, Agent, or Firm*—Carl G. Ries; Robert A. Kulason; Carl G. Seutter

[57] ABSTRACT

Alcohols may be inhibited against corrosion by addition thereto of a reaction product of maleic anhydride and certain alkoxy propyl amines.

14 Claims, No Drawings

NOVEL PROCESS AND PRODUCT

FIELD OF THE INVENTION

This invention relates to alcohol products particularly characterized by decreased ability to corrode metal surfaces with which they come into contact.

BACKGROUND OF THE INVENTION

As is well known to those skilled in the art, alcohols such as ethanol may corrode metal surfaces with which they come into contact. This is particularly true of crude or commercially available ethanols which undesirably contain acidic components commonly acetic acid. In the case of fermentation alcohols, acetic acid may be present in amount of 0.003 wt. %-0.005 wt. % of the alcohol; and this may be responsible for the fact that the alcohol causes serious corrosion problems.

It is an object of this invention to provide a novel process for decreasing the corrosion of alcohol compositions. Other objects will be apparent to those skilled in the art.

STATEMENT OF THE INVENTION

In accordance with certain of its aspects, the novel composition of this invention may comprise (i) at least one water-soluble alcohol preferably selected from the group consisting of ethanol and methanol; and (ii) an effective corrosion-inhibiting amount of the reaction product of a maleic anhydride and $$C_aH_{2a+1}—O—C_bH_{2b}—NH_2$$

wherein a is an integer greater than 5, b is an integer greater than 2, and $C_bH_{2b}$ is a straight chain alkylene group.

DESCRIPTION OF THE INVENTION

The alcohol compositions which may be treated by the process of this invention may include alkanols such as water-soluble alkanols most commonly including $C_1$-$C_4$ alcohols. Preferably, the alcohols include methanol, ethanol, propanols, etc. The alcohols may include mixtures of such alcohols with each other and/or with other compositions including ketones, esters, hydrocarbons, etc. The alcohol may be in the form of gasohol—a mixture commonly containing 80 v%-95 v%, say 90 v% gasoline and 5 v%-20 v%, say 10 v% alcohol. The alcohol may contain water, for example up to 10 w%-20 w%, typically 5 w%; but preferably it will be anhydrous. Anhydrous compositions commonly contain less than about 0.3 v% water, typically 0.001 v%-0.005 v%, say about 0.004 v% water. One preferred charge may be 100 % anhydrous ethanol. Another preferred charge may be 100 % anhydrous methanol.

Commercially available mixtures may be employed. Illustrative of one such commercially available mixture may be that having the following typical analysis:

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |

TABLE I-continued

| Component | Parts |
|---|---|
| ethyl acetate | 0.2 |

It is a particular feature of the process of this invention that it may be used to treat such compositions when they are to be used as fuels.

The fuels which may be treated by the process of this invention include gasohols which may be formed by mixing 90-95 volumes of gasoline with 5-10 volumes of ethanol or methanol. A typical gasohol may contain 90 volumes of gasoline and 10 volumes of absolute ethanol.

The fuels to be treated by the process of this invention may be substantially anhydrous i.e. they contain less than about 0.3 v% water; typically they may contain 0.001 v%-0.005 v%, say about 0.004 v% water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w%-0.005 w% of the total of the alcohol.

In accordance with practice of the process of this invention, there may be added to the alcohol a minor effective corrosion-inhibiting amount of, as a corrosion inhibiting agent, the reaction product of a maleic anhydride and $$C_aH_{2a+1}—O—C_bH_{2b}—NH_2$$

wherein a is an integer greater than 5, b is an integer greater than 2, and $C_bH_{2b}$ is a straight chain alkylene group.

The maleic anhydride which may be used in practice of the process of this invention may be maleic anhydride se, or a substituted maleic anhydride such an alkyl maleic anhydride typically a $C_1$-$C_{12}$ alkyl maleic anhydride such as methyl maleic anhydride, ethyl maleic anhydride, etc. The preferred composition is maleic anhydride se.

The amines which may be employed may be:

$$C_aH_{2a+1}—O—C_bH_{2b}—NH_2$$

wherein a is an integer greater than 5, b is an integer greater than 2, and $C_bH_{2b}$ is straight chain alkylene group, and $C_bH_{2b}$ is of the form $(CH_2)_n$ wherein n is greater than 2.

In the formula, a is an integer greater than 5, typically 6-15, preferably 13-14, say 13. b is an integer greater than 2, typically 3-6, preferably 3-4, say 3. In the preferred embodiment, a is 13, and b is 3.

Illustrative of such amine compositions may be:

TABLE

A. $C_{13}H_{27}—O—C_3H_6—NH_2$
B. $C_{10}H_{21}—O—C_3H_6O)—NH_2$
C. $C_{11}H_{23}—O—C_3H_6—NH_2$
D. $C_{12}H_{25}—O—C_3H_6—NH_2$
E. $C_{15}H_{31}—O—C_3H_6—NH_2$

The preferred amine may be the first tabulated (A) amine-tridecyloxy propyl amine.

Reaction of the amine and the maleic anhydride may be effected in the absence of catalyst by adding 100–200 parts, say 147 parts of the maleic anhydride to 600–800 parts, say 720 parts of an inert solvent. Inert solvent may include hydrocarbon oils typically 100E pale oil. The mixture is preferably heated to 30° C.–60° C., say 55° C. at atmospheric pressure as the anhydride dissolves in the solvent.

There may then be added 500–700 parts, say 600 parts of amine corresponding to a preferred mole ratio of amine:acid of 1.8–3, say 2:1. The amine is added slowly over 30–60 minutes, say 60 minutes as the reaction mixture is maintained at 80° C.–100° C. Total time of reaction is commonly 30–60 minutes, say 60 minutes.

The reaction mixture on cooling may be found to have a total base number (TBN) of 20–40, say 30.1, a total acid number (TAN) of 50–70, say 61.7, and a nitrogen content of 1 w%–3 w%, say 2.03 w%.

It appears that during a typical reaction the following may occur:

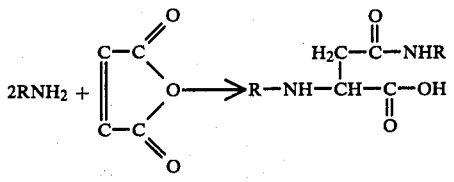

wherein R is typically tridecyloxy propyl.

Preferred reaction products may be those obtained by the reaction of:

TABLE

A. One mole of maleic anhydride and two moles of the A amine of the Table supra;
B. One mole of maleic anhydride and 2.1 moles of the A amine of the Table supra;
C. One mole of methyl maleic anhydride and 2.2 moles of the A amine of the Table supra;
D. One mole of maleic anhydride and 2.2 moles of the B amine of the Table supra;
E. One mole of methyl maleic anhydride and 1.9 moles of the A amine of the Table supra.
F. One mole of maleic anhydride and 1.9 moles of the A amine of the Table supra;
G. One mole of maleic anhydride and 1.9 moles of the B amine of the Table supra.

The preferred reaction product may be the first listed in the immediately preceding table.

The so prepared rust and corrosion inhibitors may be added to an alkanol in minor corrosion-inhibiting amount of 0.25–25, preferably 1–20 PTB, more preferably 1–5 PTB, say 2 PTB. (PTB stands for pounds of additive per thousand barrels of alcohol or fuel). Alternatively expressed, the inhibitor may be added in amount of 0.0001–0.01 w%, preferably 0.004–0.008 w%, more preferably 0.004–0.002 w%, say 0.0008 w%. Larger amounts may be employed, but may not be necessary.

It is a feature of this invention that the alcohol composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 100 ml of the test liquid in a 4 ounce bottle for 15 minutes at room temperature of 20° C. 20 ml of the test liquid is poured off and replaced with 10 ml of distilled water. The bottle is shaken the sample is maintained for 3 hours at 90° F. The percent rust on the strip is determined visually. Further reading may be taken after eg 24 hours, 40 hours, 6 days etc.

The inhibited alcohols of this invention, after 40 hours of ISCT, generally show a Rust and Corrosion rating below about 2–3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example, the preferred reaction product is prepared by adding 147 parts of maleic anhydride to 100 E Pale Oil (720 parts). The mixture is heated at 55° C. until the anhydride is dissolved. There may then be added 600 parts of the Armeen EA-13 brand of tridecyloxy propylamine.

$C_{13}H_{25}O—C_3H_6—NH_2$

Addition of the latter occurs over one hour as the temperature is allowed to rise to not exceeding 90° C. The product is recovered by cooling the reaction mixture and filtering. On analysis it is found that the TBN is 30.1, the TAN is 61.7, and the % N is 2.03.

In this Example of the best mode of practicing the invention, there is added 76.8 ppm (corresponding to 20 PTB) of the above reaction product to 90 parts of the alcohol of Table I and 10 ml distilled water. The mix is subjected to the ISCT test and the iron strip is observed after 40 hours.

EXAMPLE II

In this control Example, the procedure of Example I is followed except that the additive is made from 2 parts of $C_{10}$–$C_{12}$ alkoxy isoproxy isopropylamine.

$(C_{10}\text{-}C_{12}\text{alkyl})O—(C_3H_6O)_2—C_3H_6NH_2$

EXAMPLE III

In this control example, the procedure of Example I is duplicated except that no additive is present.

The results of the Iron Strip Corrosion Test were as follows:

TABLE

| Example | 40 hour Rust & Corrosion Rating |
|---|---|
| I | trace |
| II* | 10% |

TABLE-continued

| Example | 40 hour Rust & Corrosion Rating |
|---|---|
| III* | 35% |

From the above table, it will be apparent that the system of Example I, prepared in accordance with practice of the process of this invention, showed only a trace of rust and corrosion. Control Examples II–III showed 10%–35% rust and corrosion which is unsatisfactory.

It is noted that if the additive is made from a composition wherein $C_bH_{2b}$ is not a straight chain, unsatisfactory results will be comparable to those attained with Example II.

Results comparable to those of Example I may be obtained if the additive is formed from the following substituted anhydrieds (rather than from maleic acid):

| Example | Additive-Anhydride |
|---|---|
| IV | citraconic |
| V | itaconic |
| VI | ethylmaleic |
| VII | chloromaleic |

Results comparable to those of Example I may be obtained if the amine reactant is:

| Example | Reactant |
|---|---|
| VIII | $C_8C_{10}$ ether primary amine |
| IX | $C_{12}$–$C_{15}$ ether primary amine |
| X | $C_{10}$–$C_{12}$ ether primary amine |

Results comparable to those of Example I may be obtained if the alcohol is as follows:

| Example | Fuel |
|---|---|
| XI | Gasohol containing 90 v % gasoline and 10 v % absolute ethanol |
| XII | absolute ethanol |
| XIII | absolute methanol |

Although this invention has been illustrated by reference to specific embodiments, it will be apparent to those skilled in the art that various changes and modifications may be made which clearly fall within the scope of this invention.

I claim:

1. A composition comprising:

(i) a water-soluble alcohol; and (ii) an effective corrosion-inhibiting amount, of 0.25–25 pounds per thousand barrels of alcohol, of the reaction product of a maleic anhydride and $$C_aH_{2a+1}—O—C_bH_{2b}NH_2$$

wherein a is an integer greater than 5, b is an integer greater than 2, and $C_bH_{2b}$ is a straight chain alkylene group.

2. A composition as claimed in claim 1 wherein a is 6–15.

3. A composition as claimed in claim 1 wherein a is 13–14.

4. A composition as claimed in claim 1 wherein a is 13.

5. A composition as claimed in claim 1 wherein b is 3–6.

6. A composition as claimed in claim 1 wherein b is 3–4.

7. A composition as claimed in claim 1 wherein b is 3.

8. A composition as claimed in claim 1 wherein a is 13–14 and b is 3–6.

9. A composition as claimed in claim 1 wherein a is 13 and b is 3, $$C_{13}H_{27}—O—C_3H_6—NH_2.$$

10. A composition as claimed in claim 1 wherein said reaction product is present in effective corrosion-inhibiting amount of 1–20 pounds per thousand barrels of alcohol.

11. A composition as claimed in claim 1 wherein said alcohol is ethanol.

12. A composition comprising ethanol and 0.25–25 pounds per thousand barrels of ethanol of the reaction product of maleic acid anhydride and tridecyloxy propyl amine $C_{13}H_{27}—O—C_3H_6—NH_2$.

13. The method of treating a composition containing at least one alcohol selected from the group consisting of ethanol and methanol which comprises adding to said composition containing at least one alcohol selected from the group consisting of ethanol and methanol an effective corrosion-inhibiting amount of the reaction product of a maleic anhydride and $C_aH_{2a+1}—O—C_bH_{2b}—NH_2$ wherein a is an integer greater than 5, b is an integer greater than 2, and $C_bH_{2b}$ is a straight chain alkylene group.

14. A composition comprising:

(i) a gasohol containing a water-soluble alcohol; and (ii) an effective corrosion-inhibiting amount, of 0.25–25 pounds per thousand barrels of gasohol, of the reaction product of a maleic anhydride and $$C_aH_{2a+1}—O—C_bH_{2b}—NH_2$$

wherein a is an integer greater than 5, b is an integer greater than 2, and $C_bH_{2b}$ is a straight chain alkylene group.

* * * * *

UNITED STATES PATENT AND TRADEMARK OFFICE

CERTIFICATE OF CORRECTION

PATENT NO. : 4,348,210

DATED : September 7, 1982

INVENTOR(S) : Rodney L. Sung

It is certified that error appears in the above—identified patent and that said Letters Patent is hereby corrected as shown below:

Column 2, line 64, correct the formula to read $$--C_{10}H_{21} - 0 - C_3H_6 - NH_2--$$

Column 5, line 20, "anhydrieds" should be --anhydride--;

Column 5, line 35, "$C_8C_{10}$" should be --$C_8$-$C_{10}$--.

Signed and Sealed this

*Twenty-second* Day of *February 1983*

[SEAL]

*Attest:*

GERALD J. MOSSINGHOFF

*Attesting Officer*

*Commissioner of Patents and Trademarks*